US006138873A

United States Patent [19]

Gramola

[11] Patent Number: 6,138,873

[45] Date of Patent: Oct. 31, 2000

[54] BAYONET COUPLING BETWEEN A SPRAY PUMP AND A BOTTLE OF A SUBSTANCE TO BE SPRAYED

[75] Inventor: Marco Gramola, Alessandria, Italy

[73] Assignee: Guala Dispensing S.p.A., Spinetta Marengo, Italy

[21] Appl. No.: 09/251,435

[22] Filed: Feb. 17, 1999

[51] Int. Cl.[7] ..... B67D 5/40

[52] U.S. Cl. ..... 222/153.14; 222/383.1

[58] Field of Search ..... 222/153.14, 383.1

[56] References Cited

U.S. PATENT DOCUMENTS

| | | | |
|---|---|---|---|
| 4,345,691 | 8/1982 | Burke | 222/383.1 |
| 5,257,724 | 11/1993 | Steijns | 222/383.1 |
| 5,725,132 | 3/1998 | Foster et al. | 222/383.1 |
| 5,806,724 | 9/1998 | Foster | 222/383.1 |
| 5,810,209 | 9/1998 | Foster | 222/383.1 |

*Primary Examiner*—Joseph A. Kaufman
*Attorney, Agent, or Firm*—Nixon & Vanderhye P.C.

[57] ABSTRACT

A bayonet coupling between a spray pump and a bottle of a substance to be sprayed provides a better quality fitting between the pump and the bottle and in particular a uniformity of the relative angular position between pump and bottle. The coupling includes at least one tooth projecting from the pump, and a tooth catch projecting from the bottle, a sloping wall formed in the tooth catch over which the tooth can be snap-engaged at the time the pump is fitted axially onto the bottle, as well as, formed in the bottle, a funnel-like passage through which the tooth is to pass as the pump is fitted axially onto the bottle, so as to orient the pump angularly with respect to the bottle.

9 Claims, 4 Drawing Sheets

BAYONET COUPLING BETWEEN A SPRAY PUMP AND A BOTTLE OF A SUBSTANCE TO BE SPRAYED

FIELD OF THE INVENTION

The present invention relates to a bayonet coupling between a spray pump and a bottle of a substance to be sprayed.

BACKGROUND AND SUMMARY OF THE INVENTION

Generally, the present invention relates to a bottle of a substance to be sprayed and to a spray pump fitted to the bottle. As is known, the spray pump is fitted to the bottle by means of a bayonet coupling, which allows the spray pump to be fitted axially onto the bottle in the course of its industrial manufacture, and similarly, of course, it allows the spray pump to be detached from the bottle once the spray substance has been used up, followed by application of the same spray pump to a refill bottle in the home.

Mire specifically, the present invention relates to a bayonet coupling between a spray pump and a bottle of a substance to be sprayed.

Although the bayonet couplings that are known and currently used are satisfactory in many ways and largely serve the purpose of securely connecting the spray pump and bottle together, they nonetheless have the disadvantage that, when industrially produced, there is a lack of uniformity in the angular relationship between the pump and the bottle.

This lack of uniformity gives the impression of poor quality of manufacture and sometimes also makes the spray pump/bottle unit awkward to manipulate during spraying.

The problem that forms the starting point of the present invention is how to devise a bayonet coupling of the specified type, whose structural and functional characteristics are such as to overcome the abovementioned disadvantages.

BRIEF DESCRIPTION OF THE DRAWINGS

Other features and the advantages of the bayonet coupling according to the present invention will be made clear in the following description of a preferred embodiment thereof, which is given by way of non-limiting indication with reference to the accompanying figures, in which.

DETAILED DESCRIPTION OF THE INVENTION

Figure 1:
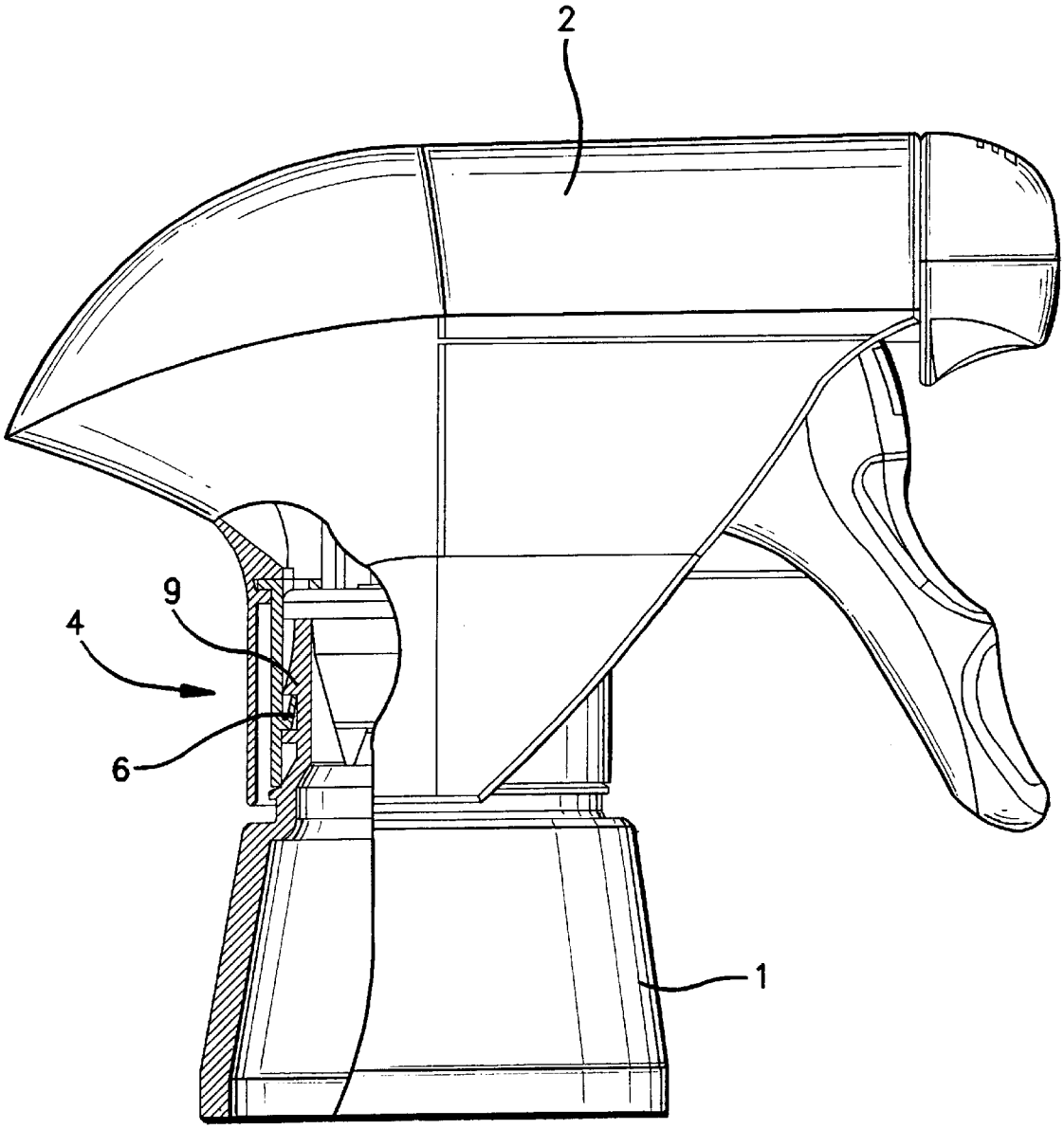
FIG. 1 shows a view in elevation and partial section of a bottle and of a spray pump fitted together by means of a bayonet coupling according to this invention.
Figure 3:
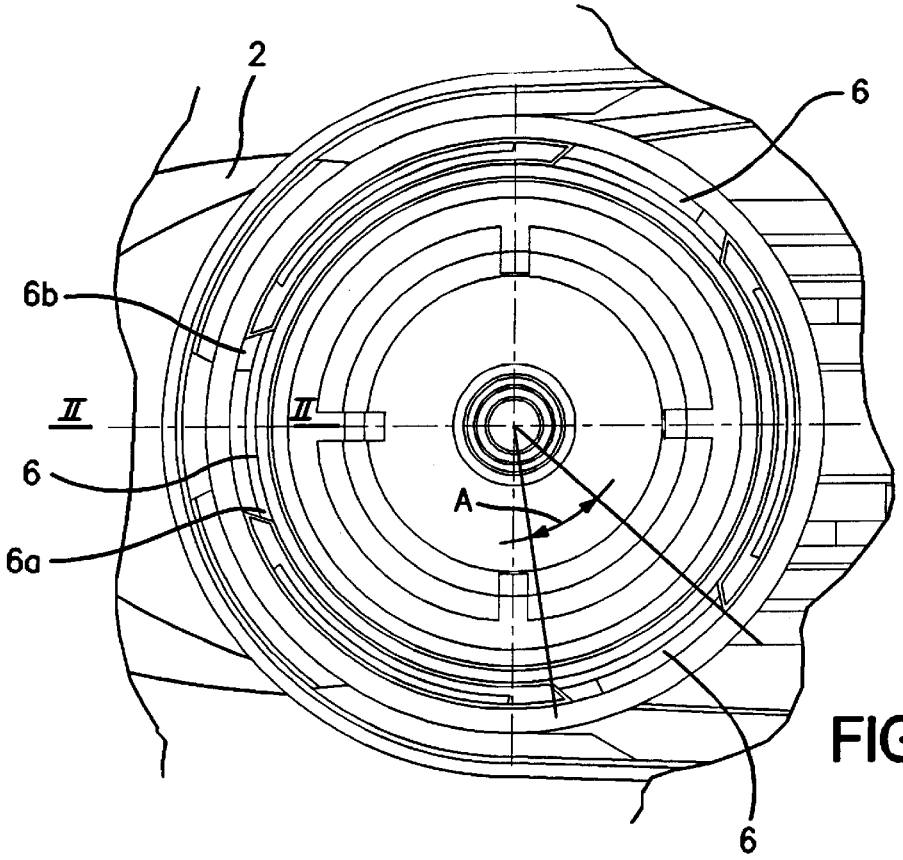
FIG. 3 shows a view from beneath of a detail of the spray pump of FIG. 1, viewed in the direction of arrow III.
Figure 2:
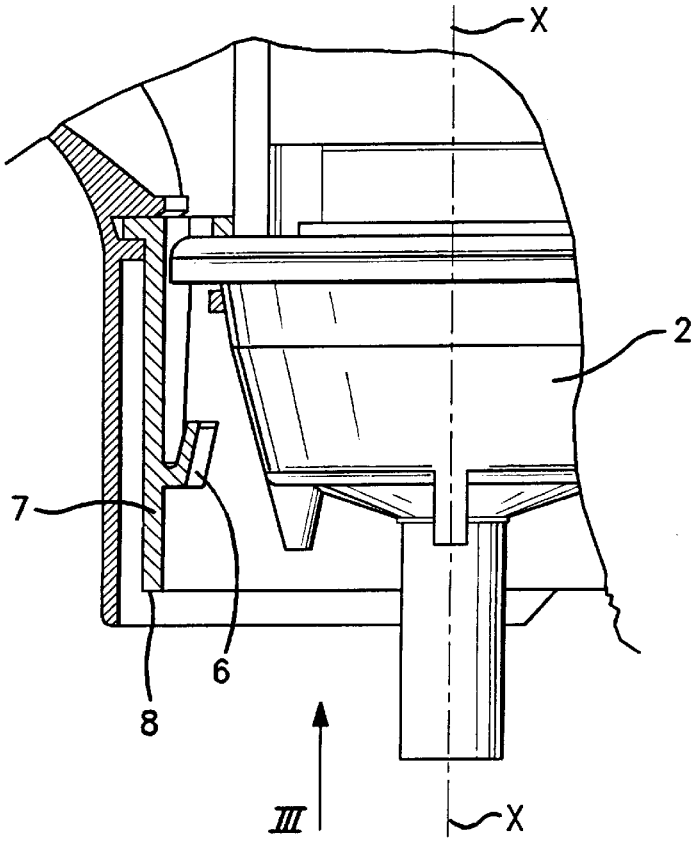
FIG. 2 shows a view in elevation and partial section of a detail of the spray pump of FIG. 1.
Figure 4:
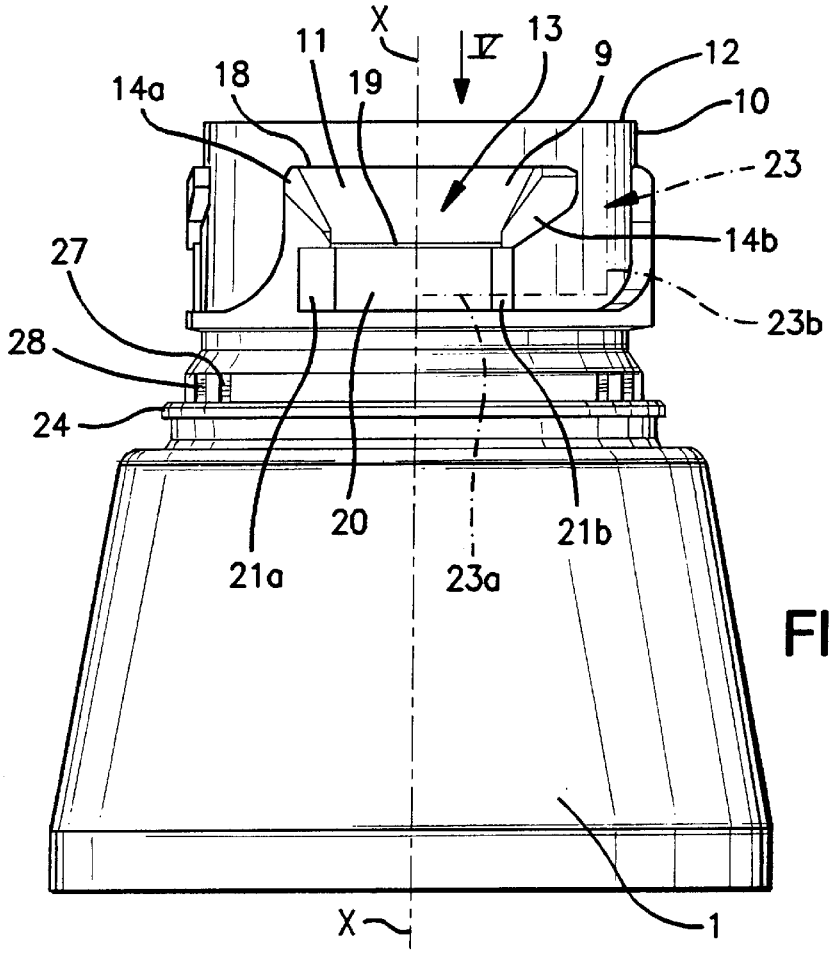
FIG. 4 shows a view in elevation of a detail of the bottle of FIG. 1.
Figure 5:
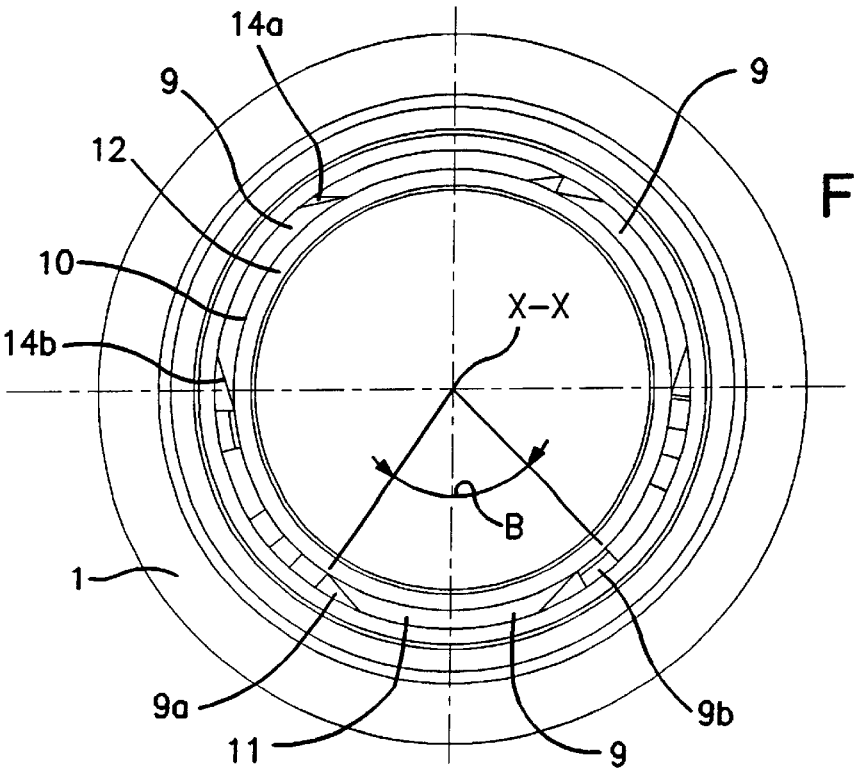
FIG. 5 shows a view from above of the bottle shown in FIG. 1, viewed in the direction of arrow V.
Figure 6:
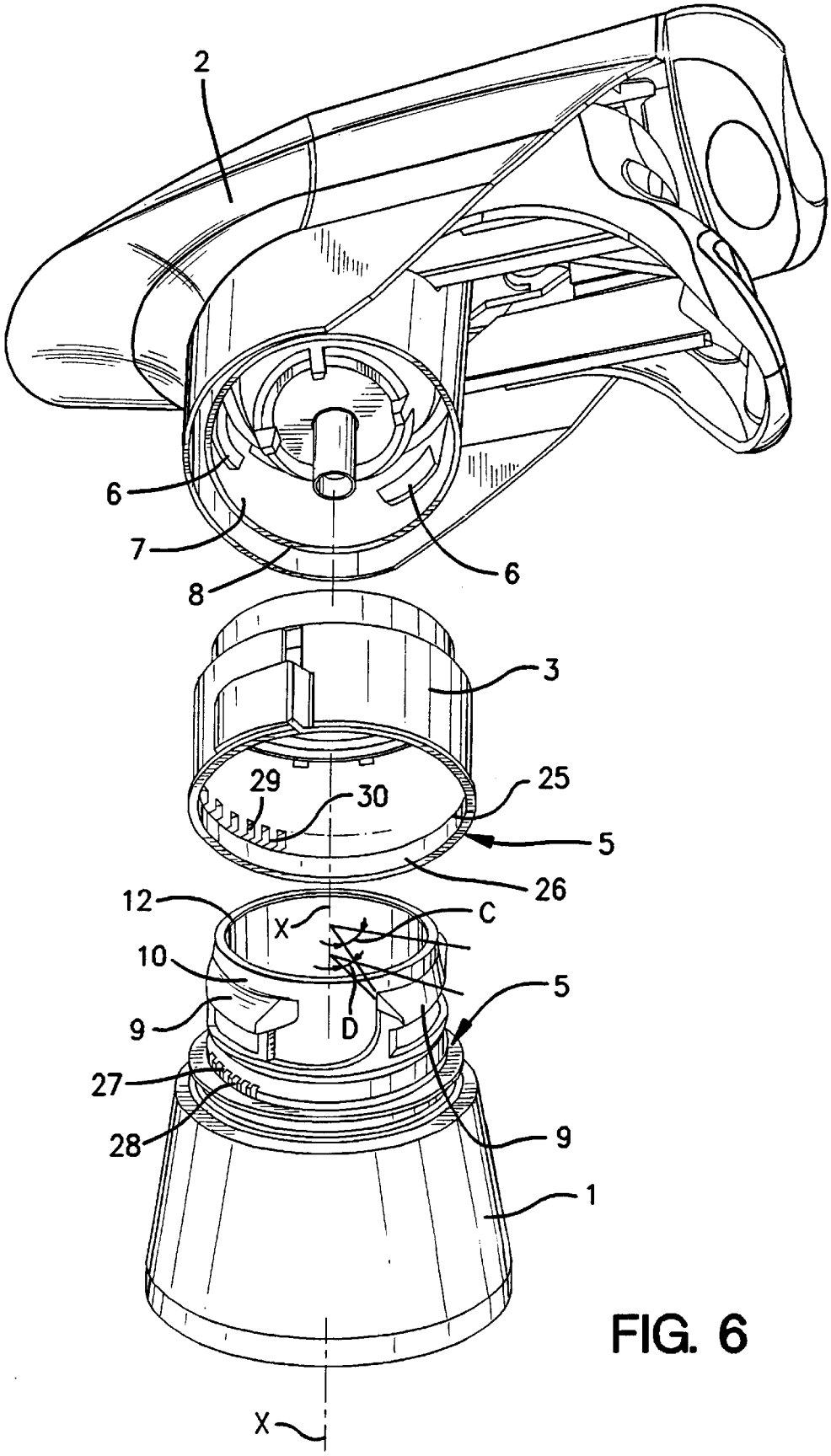
FIG. 6 shows a perspective view with parts detached of the bottle and spray pump shown in FIG. 1.

With reference to the attached figures, the numeral 1 is a general reference for a bottle of a substance to be sprayed, such as a liquid cleaning agent: if for sale as a first purchase, the bottle is intended to be fitted with a spray pump 2; or, if for sale as a refill bottle, the bottle is fitted with a stopper cap 3.

The bottle 1 and the pump 2 are flattened in form.

A bayonet coupling 4 and fixing means 5 are provided for connecting the bottle 1 to the pump 2 and to the stopper cap 3, respectively.

The bayonet coupling 4 comprises three teeth 6, which project in from a tubular sleeve 7 forming part of the pump and having axis X—X. The three teeth 6 are distributed evenly around the circumference and each has a given angular amplitude A. In this example A is 42°.

The teeth 6 are like tabs and can thus deform elastically. They extend away from a free edge 8 of the sleeve 7.

The bayonet coupling 4 also comprises three tooth catches 9, which project from a neck 10 forming part of the bottle 1, the said neck being with axis X—X.

The three tooth catches 9 are distributed evenly around the circumference and each has a given angular amplitude B, which is greater than A.

In this example B is 75°.

Each tooth catch 9 is designed to be engaged by one corresponding tooth 6 when the pump is fitted axially onto the bottle, during the industrial manufacture of bottles intended for a first purchase.

For this purpose, each tooth catch 9 comprises a sloping wall 11 that diverges with distance from the mouth 12 of the neck 10 and forms an approach surface for its respective tooth 6.

The bayonet coupling 4 comprises a funnel-like passage 13 formed in the bottle 1 at each tooth catch 9 for the respective tooth 6 to pass through when the pump is fitted axially onto the bottle.

The funnel-like passage 13 is defined by opposite flared side walls 14*a* and 14*b* projecting from the tooth catch 9 at the circumferential extremities 9*a* and 9*b* of the the tooth catch.

The funnel-like passage 13 presents an entrance aperture 18 having angular amplitude C greater than the angular amplitude A of the tooth 6 and an exit aperture 19 having angular amplitude D, which is slightly greater than the angular amplitude A of the tooth 6.

In this example, the angular amplitude C is 68.5°, while the angular amplitude D is 44°.

During axial fitting, when the tooth 6 passes over the tooth catch 9 and remains engaged by it, the tooth 6 is disposed in an exact given relative angular position with respect to the tooth catch, and the tooth 6 occupies a niche 20 formed in the neck between opposing inclined walls 21*a* and 21*b* that are formed on the neck.

In this way the pump and the bottle are positioned with respect to each other in a precise relative angular relationship.

Each tooth catch 9 is designed to disengage from its respective tooth 6, with the tooth 6 coming out of the niche 20, along an L-shaped path 23 formed in the neck, comprising a circumferential section 23*a* and an axial section 23*b*, when the pump is removed from the bottle once the spray substance has been used up.

In reverse, each tooth catch 9 on a refill bottle is designed to engage with the respective tooth 6 of the pump by following the L-shaped path in the reverse direction.

The means 5 by which the stopper cap 3 is fixed to the refill bottle 1 comprise a collar 24 formed on the neck over which an annular projection 25 formed in the stopper cap, and having a sloping wall 26, is intended to be snap-engaged, for the axial retention of the stopper cap on the bottle.

The fixing means 5 preferably also include a plurality of axial teeth 27, alternating with grooves 28, arranged circumferentially around the neck and intended to be engaged by a corresponding plurality of grooves 29 alternating with teeth 30 formed in the stopper cap, in order to prevent the stopper cap from rotating relative to the bottle.

In operation, during industrial manufacture, the bottle is fitted axially with either the pump or the stopper cap, depending on whether the bottle is for a first purchase or a refill bottle, respectively.

In operation in the home, the stopper cap is removed manually from the refill bottle and the bottle is fitted, in an L movement, with the pump, the latter having been removed with an L movement in the reverse direction from the used bottle.

In particular, when fitting the pump axially onto the first-purchased bottle, during industrial manufacture, it is possible that the bottle and pump reach the fitting station via different feed tracks with the bottle and the pump oriented differently with respect to the ideal orientation, with opposite orientations, and therefore in the wrong angular position relative to each other. In this situation, during axial fitting, one edge 6*a* or 6*b* of the tooth 6 will interfere with a flared side wall 14*a* or 14*b* of the bottle. As a result of the axial movement of the pump and bottle towards each other, the action of the flared side wall on the tooth will create a relative rotation which annuls the incorrect angular orientation.

The main advantage of the bayonet coupling according to this invention is that it enables industrial manufacture of bottles and spray pumps in a precisely uniform mutual angular relationship.

Another advantage of the bayonet coupling according to this invention is its constructional simplicity, which is no small advantage for a product produced on a very large scale.

It will be obvious that numerous modifications and alterations may be made to the bayonet coupling described above by a person skilled in the art in order to fulfill particular local needs, all such modifications and alterations remaining, however, within the scope of protection of the invention as defined in the following claims.

What I claim is:

1. A bayonet coupling between a spray pump and a bottle of a substance to be sprayed, the bayonet coupling comprising:

at least one tooth projecting from the pump;

at least one tooth catch projecting from the bottle;

a sloping wall formed in the tooth catch over which the tooth can be snap engaged at the time the pump is fitted axially onto the bottle; and a funnel-like passage through which the tooth is to pass as the pump is fitted axially onto the bottle, so as to orient the pump angularly with respect to the bottle, wherein the funnel-like passage is formed in the bottle and is positioned to guide the tooth to engage the tooth catch.

2. A bayonet coupling according to claim 1, wherein the funnel-like passage is defined by flared side walls projecting from the tooth catch.

3. A bottle for a substance to be sprayed, the bottle comprising:

at least one sloping-walled tooth catch over which a tooth of an attachment pump is intended to be snap engaged when the pump is fitted axially onto the bottle; and a funnel-like passage that is shaped for the tooth to pass through, so as to orient the pump angularly with respect to the bottle, wherein the funnel-like passage is positioned to guide the tooth of the attachment pump to engage the tooth catch.

4. A bottle according to claim 3, wherein the funnel-like passage is defined by flared side walls projecting from the tooth catch.

5. A bottle collar for receiving an attachment by axially attaching the attachment in a connecting direction, the bottle collar comprising:

at least one tooth catch projecting from the bottle collar;

a sloping wall extending from the bottle collar, the wall sloping radially outwardly in the connecting direction; and a funnel-like passage disposed upstream of the tooth catch in the connecting direction such that a tooth of the attachment that is engageable with the tooth catch is passed through the funnel-like passage prior to engaging the tooth catch in the connecting direction.

6. A bottle collar according to claim 5, wherein the funnel-like passage comprises side walls that extend radially outwardly from the bottle collar, the side walls tapering inwardly relative to the connecting direction.

7. A bottle collar according to claim 5, wherein the funnel-like passage is defined by flared side walls projecting from the tooth catch.

8. A bottle collar according to claim 7, wherein the flared side walls are disposed adjacent the sloping wall such that the funnel-like passage is defined by the flared side walls and the sloping wall.

9. A bottle collar according to claim 5, wherein the funnel-like passage is defined by side walls projecting from the bottle collar and by the sloping wall.

* * * * *